US005226275A

United States Patent [19]

Trahan

[11] Patent Number: 5,226,275

[45] Date of Patent: Jul. 13, 1993

[54] INTERLOCKING BLOCK ASSEMBLY

[76] Inventor: Denis H. Trahan, 5660, Bienville, Brossard, Quebec, Canada, J4Z 1V9

[21] Appl. No.: 713,144

[22] Filed: Jun. 11, 1991

[30] Foreign Application Priority Data

Aug. 24, 1990 [GB] United Kingdom ..... 9018590

[51] Int. Cl.[5] ..... E04C 1/00

[52] U.S. Cl. ..... 52/591; 52/594; 52/595; 446/120; D21/114

[58] Field of Search ..... 52/588-595, 52/306, 307; 446/120, 121, 127, 128, 110; D21/108, 114

[56] References Cited

U.S. PATENT DOCUMENTS

| | | | |
|---|---|---|---|
| 923,975 | 6/1909 | Johnston | 52/591 |
| 1,068,338 | 7/1913 | Hardoncourt | 52/595 X |
| 3,034,254 | 5/1962 | Christiansen | 52/594 X |
| 3,449,878 | 6/1969 | Hern | 52/589 X |
| 3,768,846 | 10/1973 | Hensley et al. | 446/120 X |
| 3,962,817 | 6/1976 | Vullierme | 446/128 |
| 4,258,522 | 3/1981 | Ararmal | 52/306 X |

FOREIGN PATENT DOCUMENTS

| | | | |
|---|---|---|---|
| 0977927 | 11/1975 | Canada | 52/594 |
| 0372815 | 12/1963 | Switzerland | 52/592 |
| 0506204 | 5/1939 | United Kingdom | 446/121 |

*Primary Examiner*—Carl D. Friedman
*Assistant Examiner*—Robert Canfield

[57] ABSTRACT

A building block made with a top face adapted to be interlocked with the lower edge of a superposed, correspondingly made block. The lower edge has an internal pending lip and a downwardly tapering wedge above and adjacent said lip. The top face has a marginal groove for receiving the pending lip of the superposed block and the top face has a ledge partly extending over the groove for gripping the wedge of the superposed block.

8 Claims, 4 Drawing Sheets

INTERLOCKING BLOCK ASSEMBLY

FIELD OF THE INVENTION

The present invention relates to construction blocks and more specifically to a system for interlocking blocks.

The blocks according to the invention which are superposed are held by a press fit arrangement and connected to adjacent ones by a dovetail arrangement and the like. The blocks are retained to one another without use of nails, screws, glue, cement or similar materials.

PRIOR ART

A search of the prior art has revealed building blocks generally connected by dovetail joints such as in Canadian patent No. 97,906 issued in 1906.

Another type of block disclosed in Canadian patent No. 124,543 makes use of ribs and recesses on superposed blocks. The ribs and recesses have corresponding sides to fit with each other. The interlocking is obtained by using mortar.

SUMMARY OF THE INVENTION

Accordingly, the present invention relates to blocks to be assembled together without the use of nails or screws or the like. The blocks are adapted to be interlockingly superposed on a corresponding block. The blocks have a top face and lateral pending walls peripherally disposed around the top face. The lateral walls have a lower edge provided with a pending lip along the inner surface of the wall. A downwardly tapering wedge member is secured to the inner surface of the wall adjacent and above the lip. A peripheral groove at the intersection of the top face and the lateral walls is also provided. The groove is adapted to allow the penetration and the support of the pending lip of a corresponding superposed block. The top face has a marginal edge extending partly over the groove for retaining the wedge and the lip of the lower edge of the superposed block in the groove.

In a specific embodiment of the invention the marginal edge is tapering downwardly to facilitate the penetration of the wedge member in the groove during assembly of the blocks. The lateral walls comprise and tenon and mortise keyways, the keyways being adapted to be connected adjacently together. The blocks are also adapted to be filled with thermally insulating material.

DESCRIPTION OF THE PREFERRED EMBODIMENT

Figure 1:
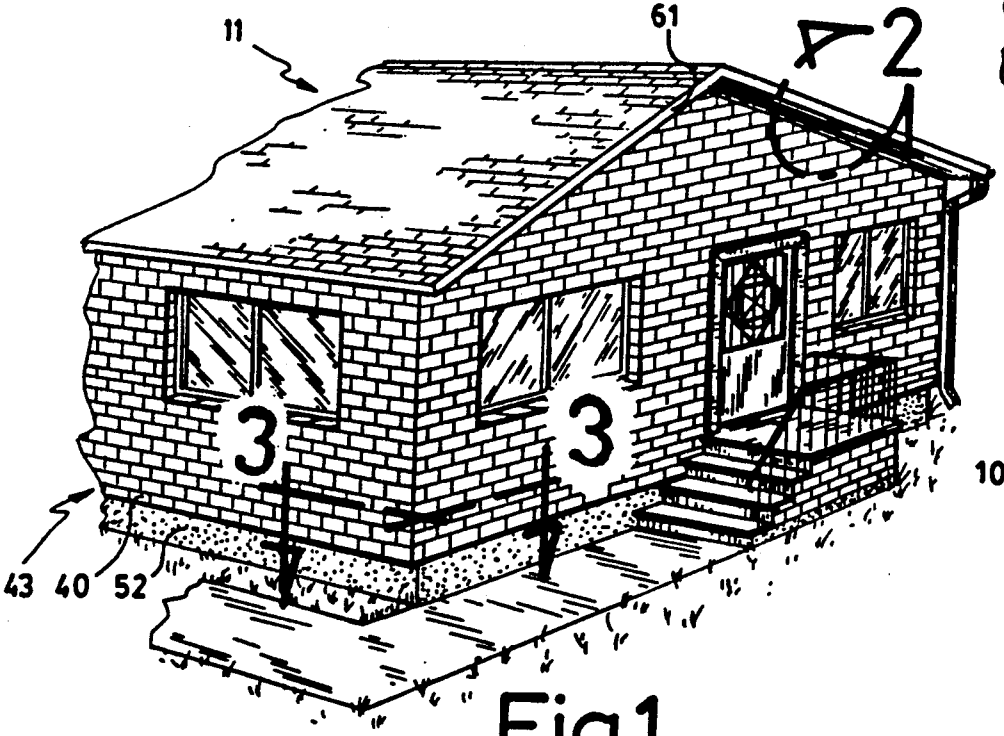
FIG. 1 is a schematic perspective view of part of a building built with the block assembly embodying the invention.
Figures 3, 4, 5, 6:
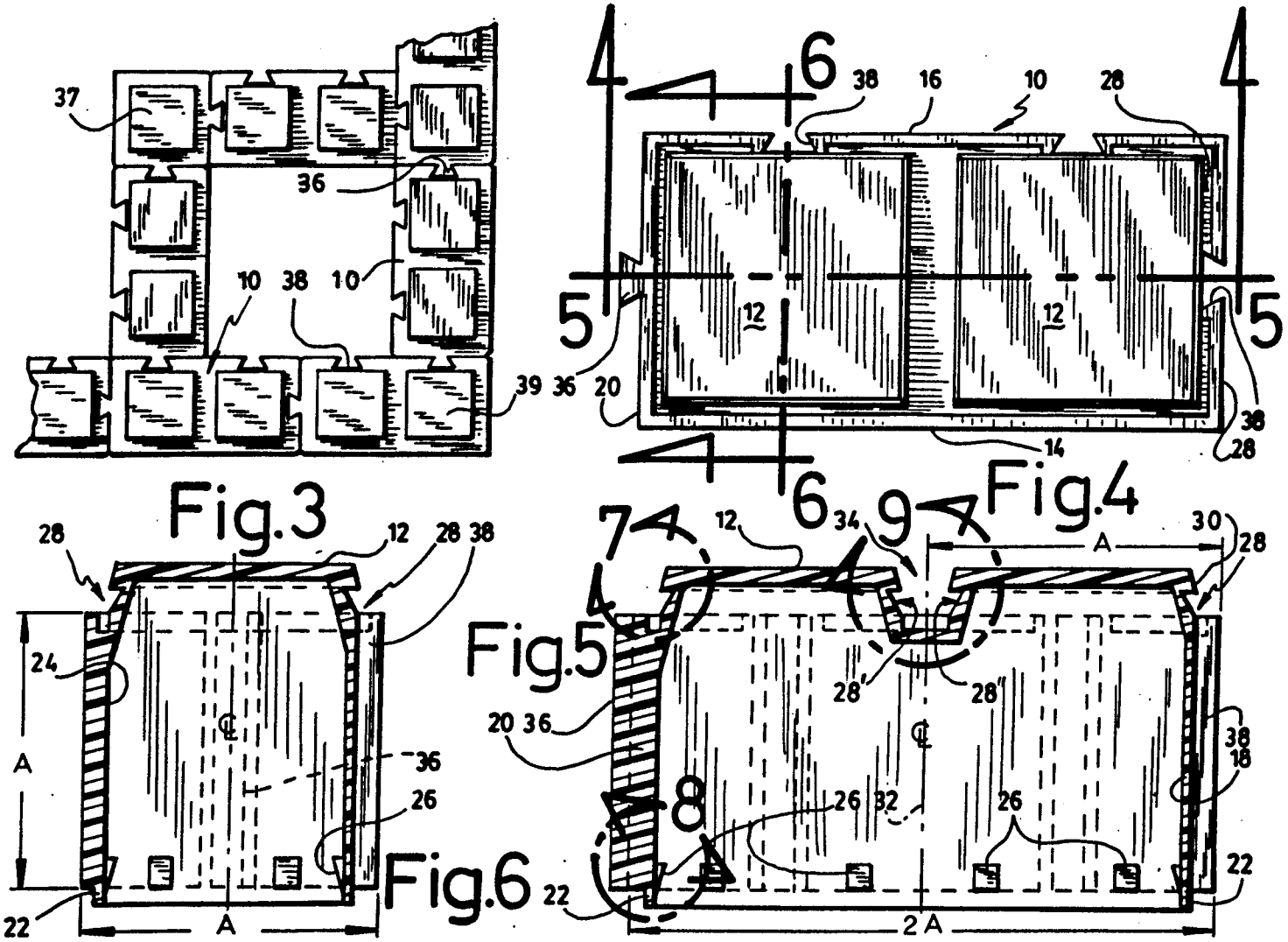
FIG. 3 is a top view taken along arrows 3—3 of FIG. 1 illustrating a set of blocks embodying the invention connected together.
FIG. 4 is a top view of one of the blocks.
FIG. 5 is a cross-sectional view taken along arrows 5—5 of FIG. 4.
FIG. 6 is a cross-sectional view taken along arrow 6 of FIG. 4.
Figure 7:
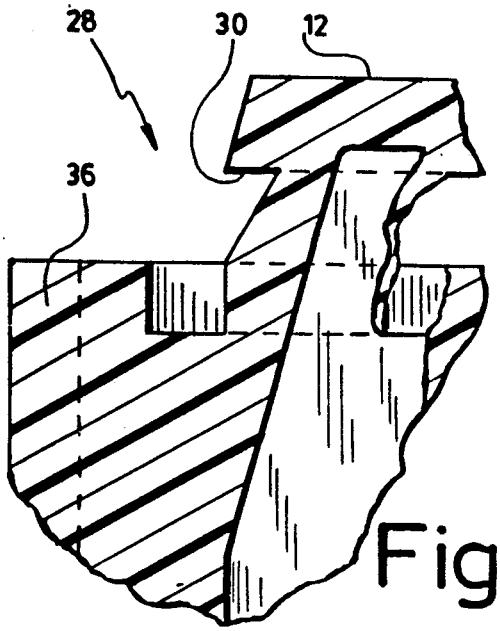
FIG. 7 is a partial detailed view of the top edge of a block taken inside arrow 7 of FIG. 5.
Figure 8:
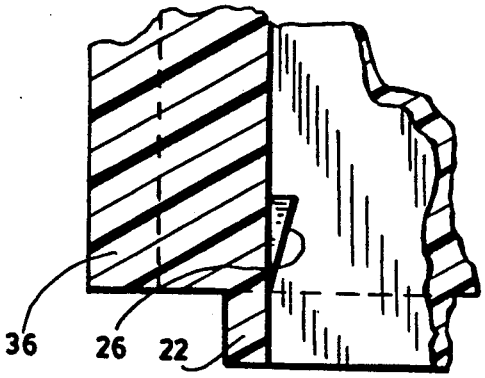
FIG. 8 is a partial detailed view of a bottom edge of the block taken inside arrows 8 of FIG. 5.
Figure 9:
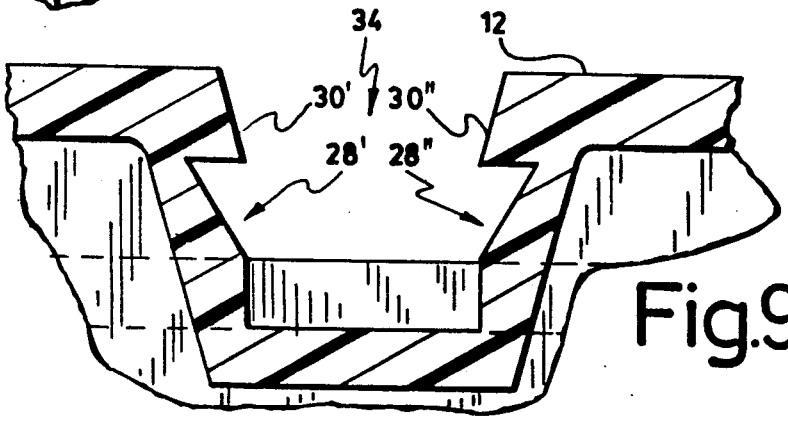
FIG. 9 is a partial detailed view of a central groove of the block taken inside arrows 9 of FIG. 5.

Referring to FIGS. 4, 5 and 6 there is shown a block 10 adapted to be superposed on a corresponding similar block in order to form structural assemblies such as the building 11 illustrated in FIG. 1.

The block 10 has a top face 12, a front wall 14, a back wall 16, a right-hand wall 18 and a left-hand wall 20. The walls 14, 16, 18 and 20 have a lower edge provided with a pending lip 22.

The pending lips 22 are provided by an extension of a portion of the thickness of the walls 14, 16, 18 and 20 along the inner lateral surface 24 of the block 10.

Figure 10:
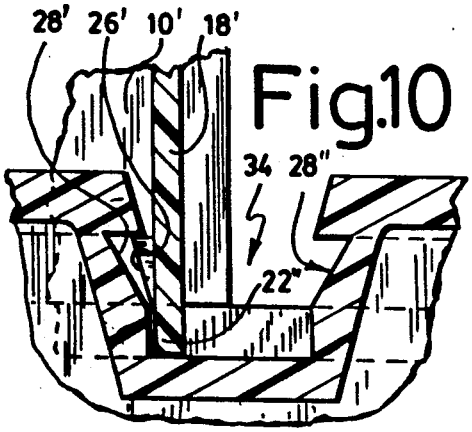
FIG. 10 is a partial detailed view of the central groove illustrated in FIG. 9 with a block superposed over the groove.
Figure 10A:
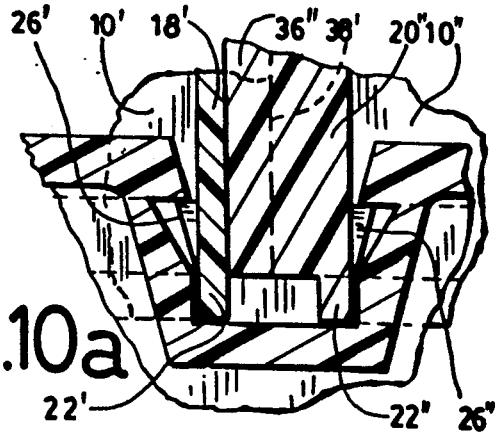
FIG. 10*a* is a view similar to FIG. 10 with two blocks mounted on top of the bottom block.
Figure 11:
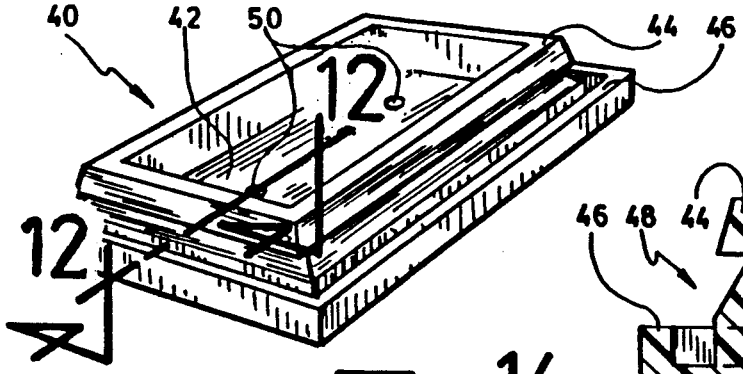
FIG. 11 is a perspective view of a base block.

Downwardly tapering wedge members 26 are secured to the inner surfaces of the walls 14, 16, 18 and 20 above and adjacent the lips 22. In the embodiment illustrated in FIGS. 6 to 15, the wedge member 26 generally consists of adjacent independent wedge block formed integrally with the inner surface 24. A peripheral groove 28 is provided at the intersection of the top face 12 and the walls 14, 16, 18 and 20. The groove 28 is adapted to allow the penetration and the support of the pending lips 22 and the wedge members 26 of a corresponding superposed block 10, as shown in FIGS. 10 and 10*a*. A marginal edge 30 extends integrally from the top surface 12 partly over the groove 28. The marginal edge 30 is adapted to retain the lips 22 and the wedge member 26 of the superposed block 10' in the groove 28 as illustrated in FIG. 10. In use, during assembly two blocks are positioned one on top of the other and a downward pressure is applied on the upper block until the wedge member 26' of the top block interlocks with the groove 28' of the bottom block. The marginal edge 30 tapers outwardly in order to allow the wedge member 26 to slide thereon during application of the downward pressure.

Various block presenting substantially the same features can be manufactured in a variety of shapes and sizes. In the embodiment, more specifically illustrated in the figures, each block 10 is adapted to support two superposed blocks 10' and 10''. The blocks 10' and 10'' are overlapping on each side, as illustrated in FIG. 1, of a center line 32 longitudinally delimiting the block 10 in two halves. When this particular embodiment is used, the block 10 is provided on its top surface 12 with a central groove 34 symmetrically disposed with regards to the center line 32. The central groove 34 which is more specifically illustrated in FIGS. 9, 10 and 10*a*, has two diametrically opposed contiguous central grooves 28' and 28" similar in shape to the peripheral groove 28. As illustrated in FIG. 10, the groove 28' fittingly receives and grips the wedge member 26' and the lip 22' of the right wall 18' of a first superposed block 10'. In FIG. 10*a*, a second superposed block 10" is mounted continuously with the first superposed block 10' on the block 10. The groove 28" grips the wedge member 26" and the lip 22" of the left wall 20" of the block 10".

In another embodiment of the invention, a block such as the top left corner block 37 in the assembly illustrated in FIG. 3 does not have a central groove 34. The block 36 is equivalent to a block 10 separated in half about its center line 32.

The two adjacent blocks 10' and 10" are connected together by a dovetail connection comprising a tenon 36" and a mortise 38". In the embodiment illustrated in FIGS. 3 to 10, the block 10 has a tenon 36 extending integrally from the left wall 20 and a mortise 38 formed in the right wall 18 as well as two mortises 38 formed integrally with the back wall 16. The blocks 10 can be arranged in a variety of patterns such as the pattern illustrated in FIG. 3. For aesthetical reasons, the bottom right corner block is exempted from having a mortise on its right-hand wall.

A set of base blocks 40 are provided to seal off the blocks 10 of the lowermost row 43 of a given construction assembly. Each base block 40 has a flat base plate 42, a connecting rim 44 extending integrally and upwardly from the flat base plate 42 and a peripheral pending lip 46 also extending upwardly from the flat base 42.

Figure 12:
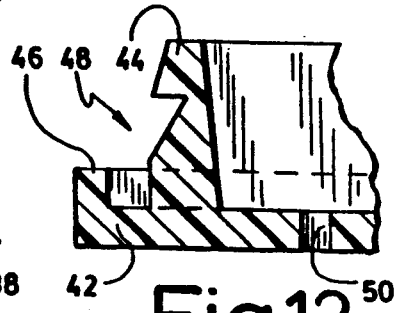
FIG. 12 is a detailed cross-sectional view taken along arrows 12—12 of FIG. 11.
Figure 13:
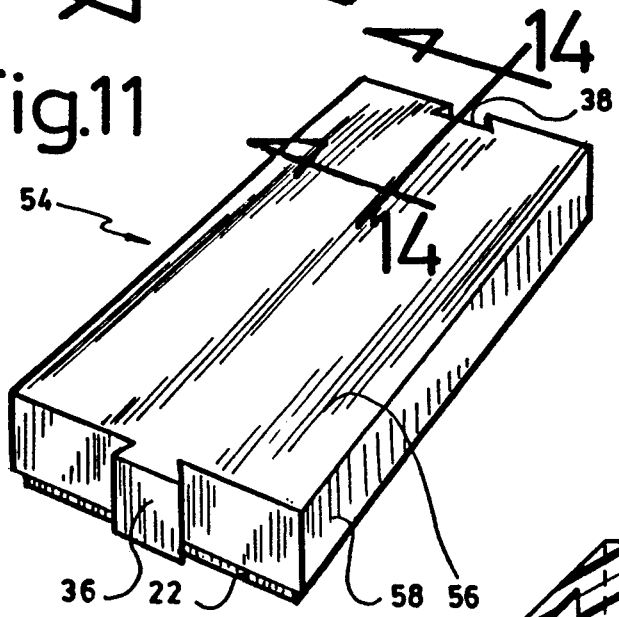
FIG. 13 is a perspective view of a flat top block.
Figure 14:
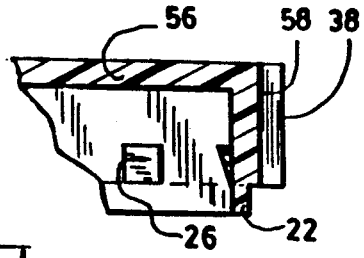
FIG. 14 is a detailed cross-sectional view taken inside arrows 14—14 of FIG. 13.
Figure 15:
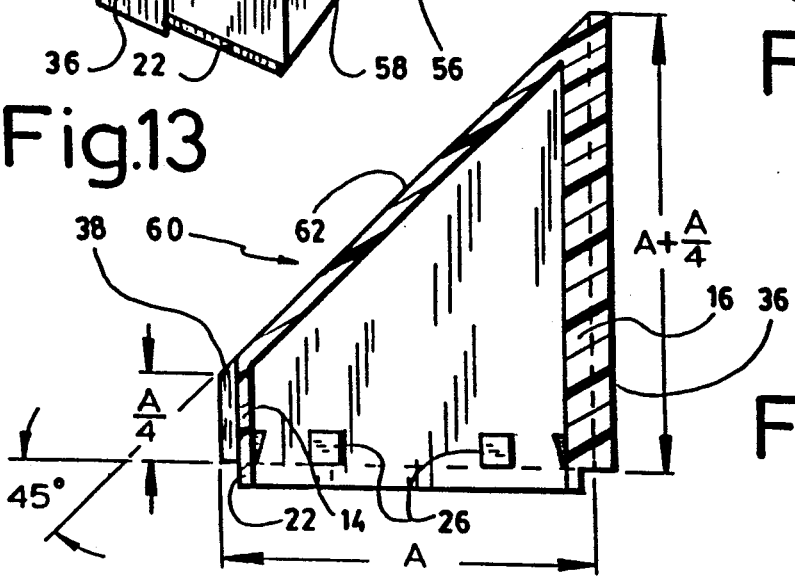
FIG. 15 is a cross-sectional view of an inclined top block.

As illustrated in FIG. 12, the rim 44 defines a groove 48 adapted to receive and grip the pending lips 22 and the wedge member 26 of the block 10 of the lowermost row 43 (see FIG. 1). A pair of apertures 50 extend through the flat base plate 42. Fixing means such as screws or bolts can be inserted in the apertures 50 to fix the base block 10 to a structural element such as a foundation 52.

A set of top cover blocks 54 are used to provide a flat top surface exempt from any grooves such as groove 28. The top cover blocks 54 have top flat plate 56 and a peripheral wall 58 extending downwardly from the top flat plate 56. The top cover blocks 54 are provided with a dove tail 36 and a mortise 38. The lip 22 and a wedge member 26 is provided for interlocking assembly with the groove 28 of the corresponding blocks 10.

Figure 2:
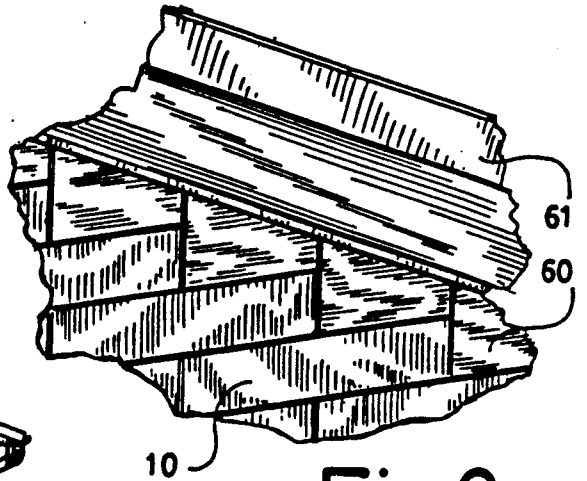
FIG. 2 is a detailed view taken along arrow 2 of FIG. 1 illustrating the connection between the front wall of the building and the roof inclined at an angle of 30 degrees.
Figure 2A:
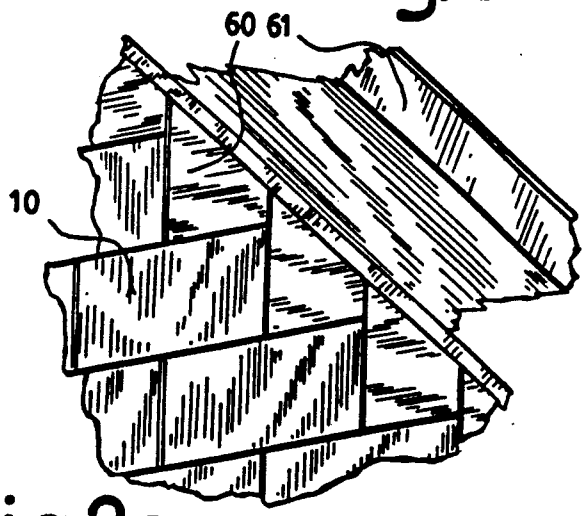
FIG. 2*a* is a detailed view similar to FIG. 2 but illustrating the connection between the front wall and a roof inclined at an angle of 45 degrees.

When the blocks 10 are used to build houses having an inclined roof 61 (FIG. 1) such as the building illustrated in FIG. 1 and 2*a*, a set of inclined top cover blocks 60 are mounted on the block 10 adjacent the roof 61. The inclined top cover blocks 60 are similar in construction to the top cover blocks 54 except that their top surface 62 is forwardly inclined and consequently, the back wall 16 is greater in length than the front wall 14. Again, the blocks 60 are provided with a lip 22 and a wedge member 36 for interlocking assembly. The blocks 10, 40, 54 and 60 being hollow, they are adapted to be filled with adequate thermally insulating material such as fiberglass wool or the like.

I claim:

1. A block assembly of interlocking upper and lower building blocks in a superposed arrangement, said blocks having a top face and peripheral lateral walls adjacently surrounding said top face, said lateral walls having a lower edge, and said top face having a marginal edge which forms a peripheral groove with said peripheral walls, the lower edge of said lateral walls of the upper block adapted to be fittingly fixed in the peripheral groove of the lower block, said lower edge having a pending lip extending below said lower edge and an internally projecting wedge member tapering away from said top face, said peripheral groove having a cross-section corresponding to said lower edge, to said pending lip and to said wedge member for fittingly receiving and gripping said lower edge, said lip and wedge member, whereby a downward pressure on said upper block over said lower block causes an insertion of the lower edge, the lip and the wedge member of the upper block in the peripheral groove of the lower block and provides an interlocking of the two superposed blocks.

2. A block assembly as recited in claim 1, wherein the pending lip is provided by an extention of a portion of the thickness of an inner surface the lateral walls, the peripheral groove being correspondingly shaped to receive said lip.

3. A block assembly as recited in claim 2, wherein the marginal edge of the top face adjacent the peripheral groove tapers outwardly for allowing said wedge member to slide thereon upon said downward pressure.

4. A block adapted to interlockingly support a superposed similar corresponding block, said block having a top face and lateral pending walls peripherally disposed around said top face, said lateral walls having a lower edge provided with a pending lip along an inner surface of said walls, a wedge member tapering away from said top face, said wedge member being secured to said inner surface above and adjacent said lip, a peripheral groove along said top face adjacent said lateral walls, said groove adapted to allow a penetration and a support of a pending lip of a similar corresponding superposed block, said top face having a marginal edge extending partly over said groove for retaining a wedge member and a lower edge of a superposed similar corresponding block, in said groove.

5. A block as recited in claim 4, wherein said marginal edge is tapering downwardly to facilitate the penetration of a wedge member of a superposed block in the peripheral groove.

6. A block as recited in claim 5, wherein said lateral walls comprise tenon and mortise keyways, said keyways adapted to connect laterally adjacent corresponding blocks together.

7. A block as recited in claim 6, wherein said block is filled with a thermally insulating material.

8. A rectangular building block having a center-line defining two square blocks, said rectangular block comprising a top face and pending walls having a lower edge provided with a pending lip extending along an inner surface of said walls, and a wedge member tapering away from said top face and secured to said inner surface above and adjacent said lip, said top face and said lateral walls intersecting to form a peripheral groove, and said block having a central transversal groove having a cross-section corresponding to the cross-section of two contiguous said peripheral grooves, one on each side of said center-line, said peripheral groove extending in said lateral walls, said top face having a marginal ledge extending partly over said grooves, whereby the top face of said rectangular block is adapted to superposedly interlock with a lower edge of two corresponding similar blocks adjacently disposed along said center line.

* * * * *